US008056291B1

(12) United States Patent
diGirolamo et al.

(10) Patent No.: US 8,056,291 B1
(45) Date of Patent: Nov. 15, 2011

(54) CONCRETE AND LIGHT GAUGE COLD FORMED STEEL BUILDING STRUCTURE WITH BEAM AND FLOOR EXTENDING OVER A LOAD BEARING STUD WALL AND METHOD OF FORMING

(75) Inventors: Edward R. diGirolamo, Raleigh, NC (US); Nabil Abdel-Rahman, Raleigh, NC (US); Thomas Trestain, Toronto (CA); Michael Booth, Raleigh, NC (US); Gary Bennett, Macon, NC (US); Teoman Pekoz, Ithaca, NY (US)

(73) Assignee: The Steel Networks, Inc., Raleigh, NC (US)

( * ) Notice: Subject to any disclaimer, the term of this patent is extended or adjusted under 35 U.S.C. 154(b) by 1046 days.

(21) Appl. No.: 11/871,634

(22) Filed: Oct. 12, 2007

(51) Int. Cl.
*E04B 1/16* (2006.01)
*E04B 1/24* (2006.01)
*E04B 5/19* (2006.01)
*E04G 21/02* (2006.01)

(52) U.S. Cl. ..... 52/250; 52/327; 52/414; 52/745.05

(58) Field of Classification Search ..... 52/250, 52/258; 264/31, 35
See application file for complete search history.

(56) References Cited

U.S. PATENT DOCUMENTS

| | | | | | |
|---|---|---|---|---|---|
| 671,596 | A | * | 4/1901 | Himmelwright | 52/326 |
| 714,047 | A | * | 11/1902 | Shields | 52/250 |
| 720,165 | A | * | 2/1903 | Lyon et al. | 52/327 |
| 739,030 | A | * | 9/1903 | Simpson et al. | 52/252 |
| 794,246 | A | * | 7/1905 | O'Shea | 52/326 |
| 856,371 | A | * | 6/1907 | Scammell | 249/23 |
| 1,171,400 | A | * | 2/1916 | Hoge | 52/231 |
| 1,235,636 | A | * | 8/1917 | Bagnall et al. | 52/326 |
| 1,701,113 | A | * | 2/1929 | Keller | 264/33 |
| 1,978,012 | A | * | 10/1934 | Cavey | 52/745.05 |
| 2,123,923 | A | * | 7/1938 | Alsted | 52/327 |
| 2,218,705 | A | * | 10/1940 | Faber | 264/31 |
| 2,284,923 | A | * | 6/1942 | Schick | 52/250 |
| 2,298,989 | A | * | 10/1942 | Underwood | 52/264 |
| 2,379,636 | A | * | 7/1945 | Hedgren | 52/745.05 |
| 3,251,167 | A | * | 5/1966 | Curran | 52/327 |
| 3,392,499 | A | * | 7/1968 | McManus | 52/702 |
| 3,890,750 | A | * | 6/1975 | Berman et al. | 52/250 |
| 4,081,935 | A | * | 4/1978 | Wise | 52/236.8 |
| 4,363,200 | A | * | 12/1982 | Goldenberg | 52/251 |
| 4,409,764 | A | * | 10/1983 | Wilnau | 52/127.3 |
| 4,628,654 | A | * | 12/1986 | Boswel | 52/319 |
| 4,646,496 | A | * | 3/1987 | Wilnau | 52/252 |
| 4,685,264 | A | * | 8/1987 | Landis | 52/252 |
| 4,715,155 | A | * | 12/1987 | Holtz | 52/333 |
| 4,918,897 | A | * | 4/1990 | Luedtke | 52/742.14 |
| 5,016,411 | A | * | 5/1991 | Thorsnes | 52/220.4 |
| 5,048,257 | A | * | 9/1991 | Luedtke | 52/747.1 |
| 5,050,358 | A | * | 9/1991 | Vladislavic | 52/334 |
| 5,113,631 | A | * | 5/1992 | diGirolamo et al. | 52/236.8 |

(Continued)

*Primary Examiner* — Michael Safavi
(74) *Attorney, Agent, or Firm* — Coats & Bennett, P.L.L.C.

(57) ABSTRACT

A series of spaced-apart light gauge cold formed steel studs underlie an elongated light gauge cold formed steel channel or box. A series of joist supports are connected to the channel and a series of joists, formed of a light gauge cold formed steel, are connected to the joist supports and extend outwardly from the box. Decking is supported on the joist. Concrete is poured into the channel to form a reinforced header or beam, and concrete is also poured onto the decking to form a concrete floor. Together, the concrete floor and header form a monolithic concrete structure that enables the joist to be misaligned with studs.

18 Claims, 8 Drawing Sheets

U.S. PATENT DOCUMENTS 5,941,035 A * 8/1999 Purse ..... 52/263
6,625,943 B1 * 9/2003 Renner ..... 52/251
7,389,620 B1 * 6/2008 McManus ..... 52/414
2005/0188638 A1 * 9/2005 Pace ..... 52/414
2009/0126312 A1 * 5/2009 Raimondi et al. ..... 52/745.05
2009/0188193 A1 * 7/2009 Studebaker et al. ..... 52/321

* cited by examiner

CONCRETE AND LIGHT GAUGE COLD FORMED STEEL BUILDING STRUCTURE WITH BEAM AND FLOOR EXTENDING OVER A LOAD BEARING STUD WALL AND METHOD OF FORMING

FIELD OF THE INVENTION

The present invention relates to building structures and, more particularly, to a combination concrete and light gauge cold formed steel building structure.

BACKGROUND OF THE INVENTION

Typically in light gauge steel construction, load bearing components, such as studs and joists, are aligned. That is, load bearing studs on an upper floor are generally aligned with load bearing studs on a lower floor. Likewise, joists are usually aligned with studs in order to carry loads. This, of course, mandates a fairly rigid design with respect to studs and joists used in load bearing structures. Because of that, overall designs are less flexible.

SUMMARY

A load-bearing wall is provided that includes a series of spaced-apart studs that support a beam former and a concrete beam or header that extends through the beam former. The beam former forms a part of the building structure even after a concrete beam or header is formed therein.

Another aspect of the building structure disclosed herein entails utilizing light gauge cold formed steel components to form a load-bearing wall that comprises light gauge cold formed steel studs, a beam former formed of light gauge cold formed steel material, and a concrete beam or header formed in the beam former.

Yet another aspect of the building structure disclosed herein entails utilizing light gauge cold formed steel components in a building structure to support a monolithic concrete structure comprising a concrete floor and a concrete beam where the concrete beam portion of the monolithic structure is formed in place by a beam former constructed of light gauge cold formed steel.

Other objects and advantages of the present invention will become apparent and obvious from a study of the following description and the accompanying drawings which are merely illustrative of such invention.

DESCRIPTION OF EXEMPLARY EMBODIMENT

With further reference to the drawings, a building structure is shown therein and indicated generally by the numeral 10. Building structure 10 entails a building system for uniformly distributing floor loads utilizing cold formed steel floor joists in load-bearing stud wall applications. As will be appreciated from subsequent discussions, the building structure 10 combines reinforced concrete and light gauge cold formed steel. With respect to the concrete component of the building structure 10, a monolithic concrete structure is formed including a floor portion and a beam or header portion. The beam or header portion is formed by a light gauge cold formed steel component that is structural and also functions to form the beam or header portion of the monolithic concrete structure.

Figure 1:
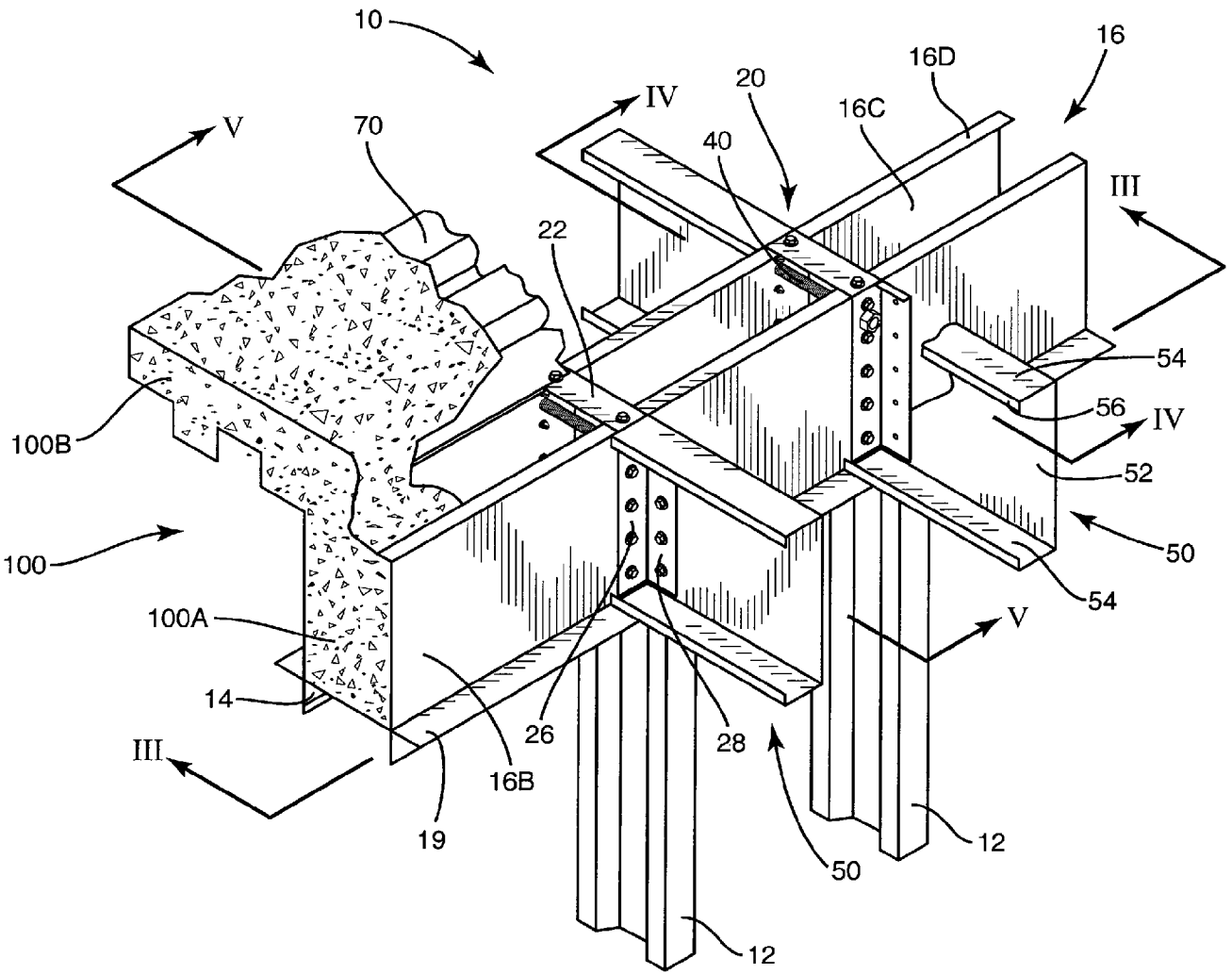
FIG. 1 is a fragmentary perspective view showing a portion of the building structure described herein.

Turning to the drawings, and particularly to FIG. 1, the building structure 10 includes a series of spaced-apart studs 12. The studs 12 are light gauge cold formed steel studs. Studs 12 typically form a part of a load-bearing wall which is adapted to receive sheet rock, sheathing, or other types of wall board. Studs 12 typically extend between upper and lower channels. As illustrated in FIG. 1, there is an upper U-shaped channel 14 that again is of a light gauge cold formed steel construction. The upper portions of the studs 12 are secured to the upper channel 14.

Supported by the studs 12 and resting on the upper channel 14 is a beam former indicated generally by the numeral 16. In this case, beam former 16 is constructed of a light gauge cold formed steel. Beam former 16 includes a bottom 16A (FIG. 7), pair of opposed sides 16B, open top 16C, and a pair of opposed flanges or stiffeners 16D. Although not shown, during construction, the ends of the beam former 16 would be provided with pour stops in order to confine concrete poured into the beam former 16. Beam former, as used here, means an elongated structure made of light gauge cold formed steel that includes a bottom, pair of sides, and open top, and which receives concrete and forms in place the concrete into a beam or holder. Light gauge cold formed steel refers to steel having a gauge in the range of 10-25 and which is formed into a building component, such as a stud or joist, by a cold forming process.

Figure 10:
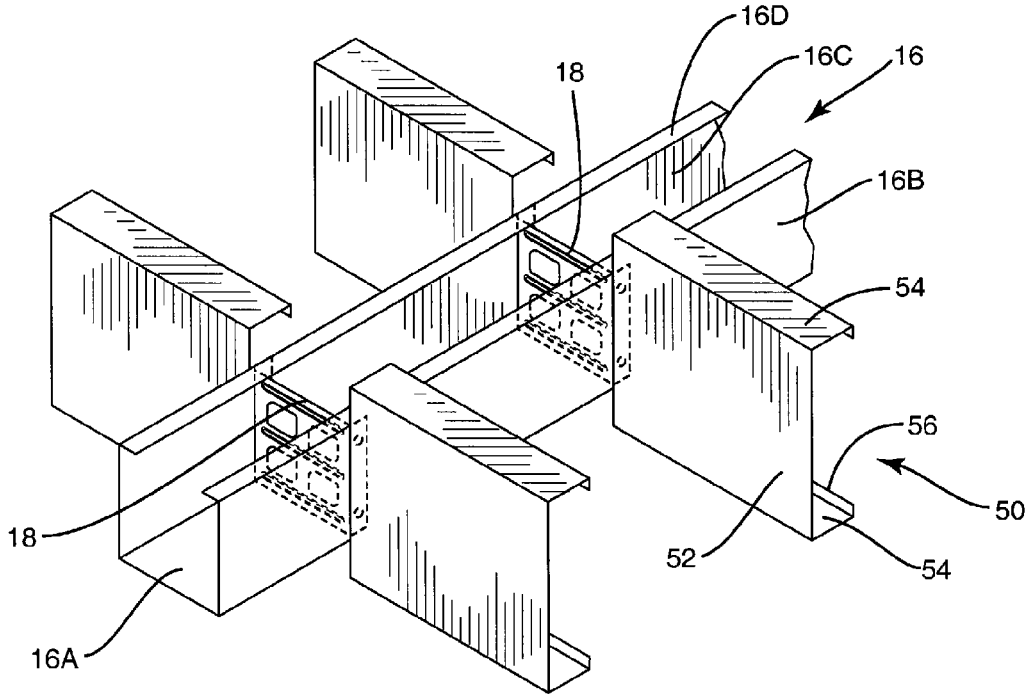
FIG. 10 is a fragmentary perspective view illustrating the use of reinforcing plates within the beam former.

Beam former 16 can be formed of a single piece of light gauge steel, or two generally L-shaped pieces of light gauge steel can be disposed adjacent each other to form a generally channel-like structure. In some case, it may be desirable to reinforce the beam former 16. In FIG. 10, there is shown a series of reinforcing plates 18 spaced along the longitudinal axis of the beam former 16. Each reinforcing plate 18 in this embodiment includes a series of openings that permits concrete to flow therethrough. In addition, the openings and reinforcing plates 18 facilitate tying the plates 18 to the concrete beam formed by the beam former 16. As will be discussed subsequently herein, a series of joists are connected and extend outwardly from the beam former 16. In cases where the reinforcing plates 18 are used, it may be preferable to align the reinforcing plates 18 with the joist.

Figure 4:
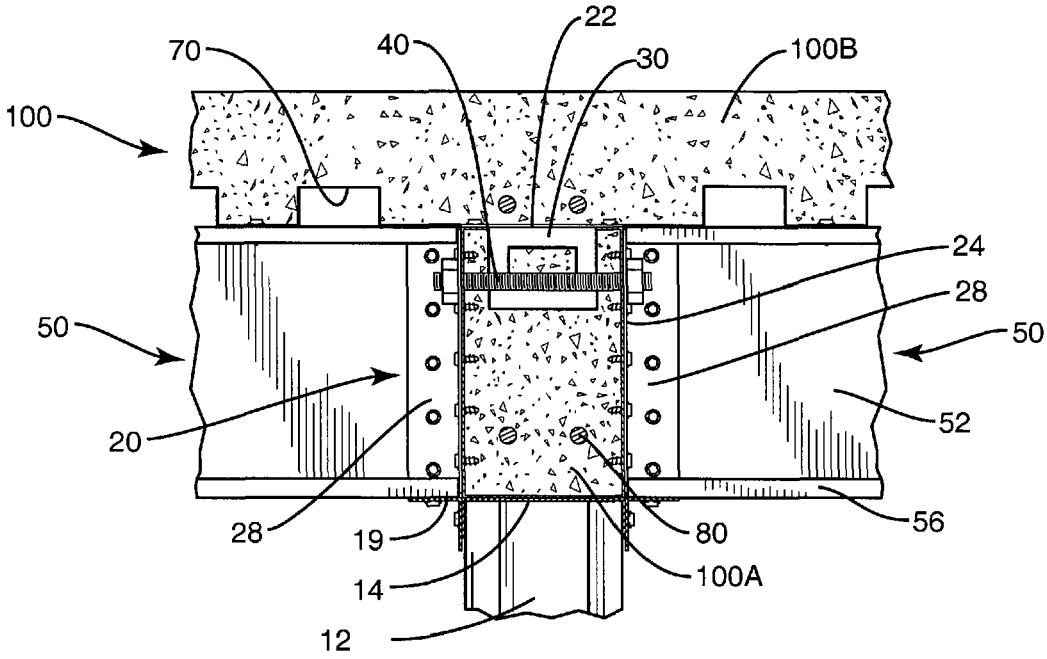
FIG. 4 is a sectional view taken along the line IV-IV of FIG. 1.

Extending along opposite sides of the upper channel 14 is a pair of optional angle stiffeners 19. This is best illustrated in FIG. 4. The angled stiffener 19 is secured to the respective studs 12 and includes a top flange that projects outwardly from the lower portion of the beam former 16. This upper flange may be utilized to support lower portion of joists that are connected to the beam former 16 and which will be discussed subsequently herein.

Secured in spaced-apart relationship to the beam former 16 is a series of joist hangers or joist supports 20. Joist supports 20 are secured to the beam former 16. As seen in the drawings, the joist supports 20 straddle the beam former 16 and are generally connected to the sides 16B and upper flanges 16D of the beam former 16.

Figure 6:
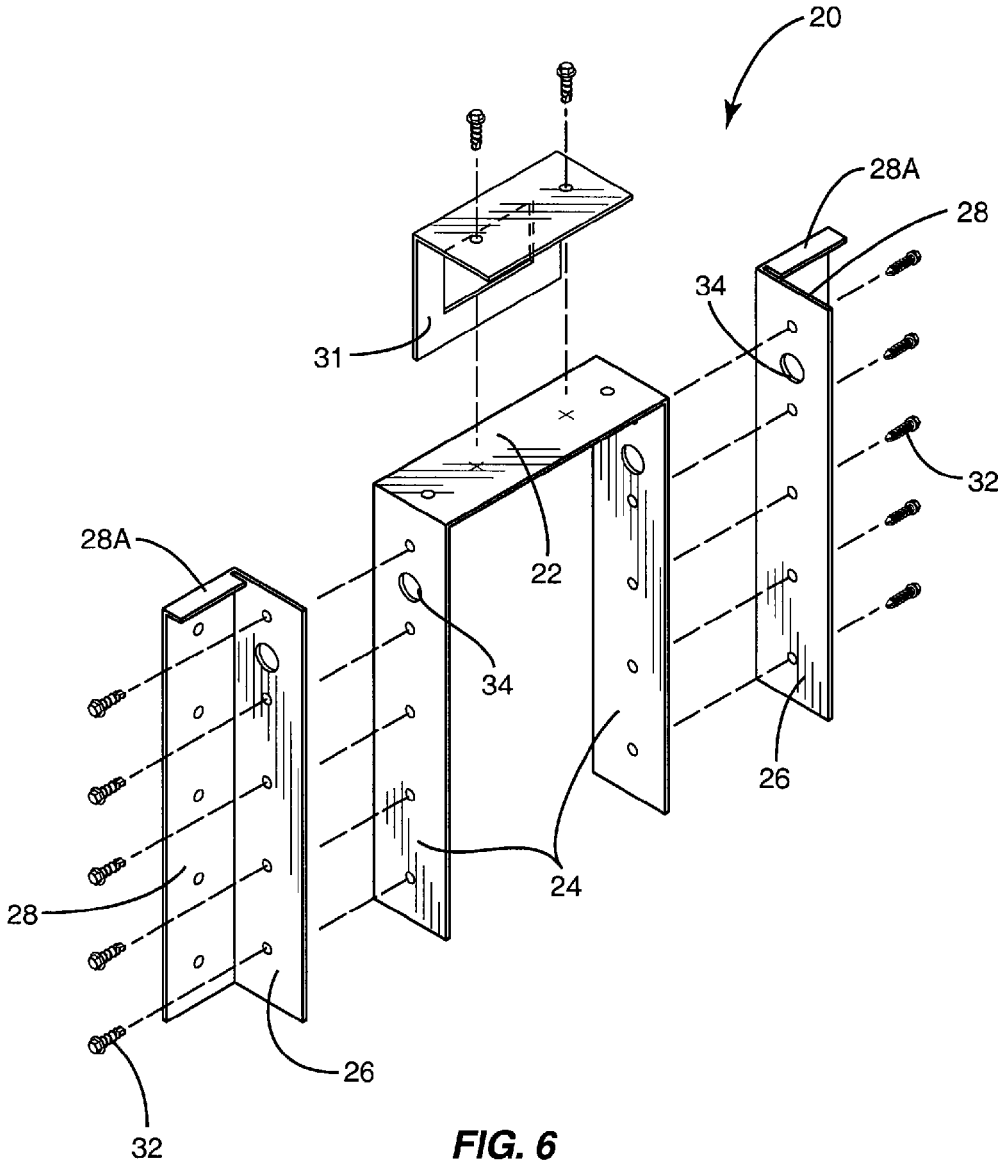
FIG. 6 is an exploded perspective view showing a joist support structure.

As illustrated in FIG. 6, one example of a joist support 20 assumes a generally inverted U-shaped configuration. The joist support 20 shown in FIG. 6 comprises a multi-piece construction that includes cross member 22 and a pair of legs 24 that depend down from the cross member 22. An angled bracket is secured to each leg 24. The angled bracket includes a connector strip 26 that connects to a respective leg 24 and a flange 28 that projects at a generally 90° angle from the connector strip 26. Formed on the upper edge of the flange 28 is a tab 28A. Tab 28A serves as a temporary support for joists prior to the joists being connected to the joist support 20. In addition, each joist hanger of the embodiment shown in FIG. 6 includes a tab 31. Tab 31 is secured to the cross member 22 and projects downwardly therefrom. Tab 31 includes an opening. When concrete is poured into the beam former 16, the concrete will surround portions of the tab, and the opening within the tab will effectively tie the tab to the concrete beam or header formed in the beam former 16. As noted above, the joist support 20 is of a multi-piece type. However, it should be understood that the joist support 20 could be of a single piece construction. Provided with the joist support 20 is a series of fasteners 32 that fasten the angle brackets to the legs 24 and which effectively secure the joist hanger to the beam former 16.

As an optional feature, a bolt or tie rod 40 extends through the joist support 20 and through the beam former 16. To accommodate the bolt or tie rod 40, bolt openings 34 are provided in the legs 24 and strips 26 of the joist support. When the bolt or tie rod 40 is used, it follows that the concrete is poured into the beam former 16 and concrete will surround the bolt or tie rod 40 and effectively tie the concrete beam to the joist hanger 20, the beam former 16, and subsequently the joist.

Building structure 10 further includes a series of joists, with each joist being indicated generally by the numeral 50. Each joist 50 is of a light gauge cold formed steel construction and includes a web 52, a pair of opposed flanges 54, and a return or stiffener 56. Note that each joist 50 is connected to a joist hanger 20. In particular, the flange on either side of the joist hanger 20 projects slightly into the end of the joists 50 and is fastened thereto by screws or other connecting means. As illustrated in FIG. 4, for example, the joist 50 rests on the upper ledge of the angled stiffeners 19 that extend adjacent each side of the track 14 if the stiffeners are used. Otherwise, the joist rests on tab 28A of the joist hangar.

A metal deck 70 is supported by and secured to the joists 50. See FIGS. 1, 2, 4, and 5. Deck 70 is secured by screws or other types of fasteners to the upper flanges 54 of the respective joists 50. In addition, as seen in FIG. 1, the deck 70 includes an outer edge that projects over the stiffener 16B of the beam former 16. Deck 70 can be secured to the beam former 16 by screws extending through an edge portion of the deck 70 into and through the stiffeners 16D.

Figure 2:
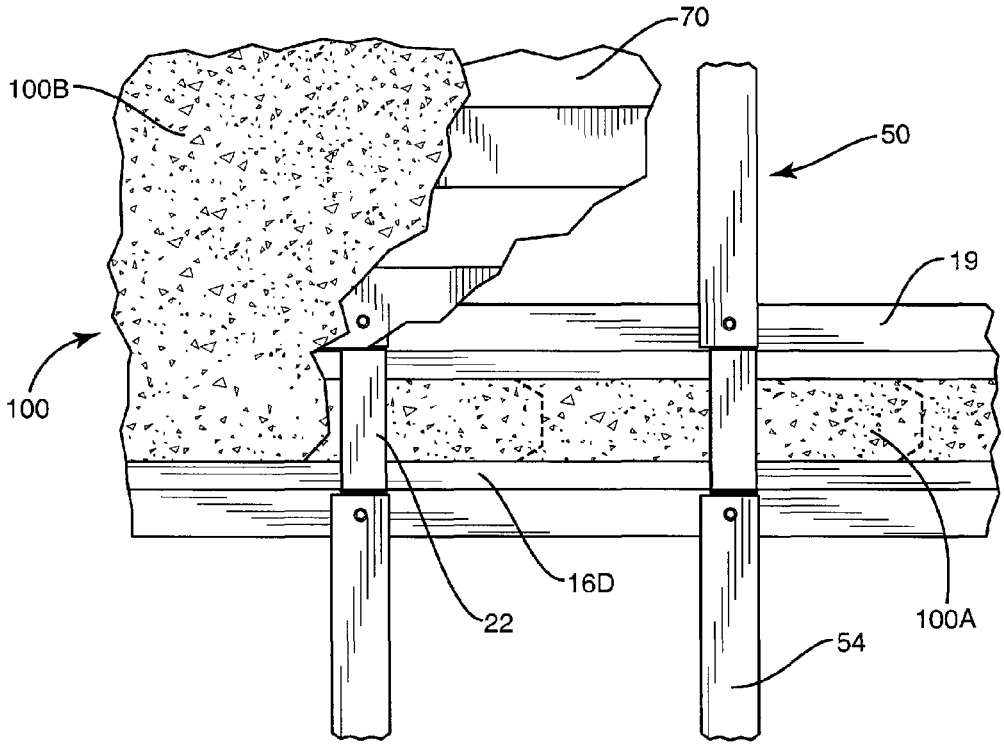
FIG. 2 is a fragmentary top plan view of a portion of the building structure shown in FIG. 1.
Figure 5:
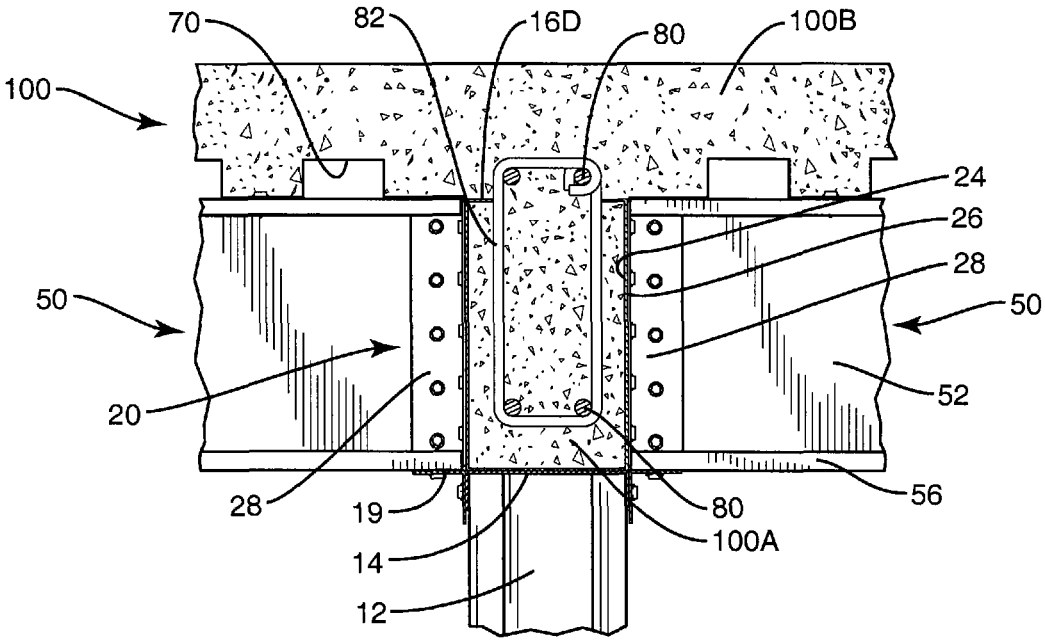
FIG. 5 is a sectional view taken along the line V-V of FIG. 1.

Beam former 16 is a structural member of the building structure 10. In addition, beam former 16 functions to permit a concrete beam or a concrete header to be poured in place over the load-bearing wall formed by studs 12. It is desirable to reinforce the concrete that will form the beam or header within the beam former 16. This is illustrated in FIG. 5. Here, rebar is strategically located in the beam former 16 prior to pouring. In this case, a series of rebar 80 is extended generally longitudinally through the beam former 16. As seen in FIG. 2, two pieces of rebar extend along a lower portion of the beam former 16, while two other pieces of rebar 80 are disposed slightly above the top portion of the beam former 16. The longitudinal pieces of rebar 80 are interconnected with a generally rectangular or square run 82 of rebar. Note in FIG. 5 where the square or rectangular run of rebar basically encircles the longitudinal pieces of rebar set in the beam former 16.

Once the load-bearing wall has been set and the various components, such as the beam former 16, joists 50, and deck 70, have been set, then concrete can be poured. The concrete is poured onto deck 70 and permitted to spill over into the beam former 16. This forms a monolithic concrete structure indicated generally by the numeral 100. This monolithic concrete structure includes a beam or header portion 100A and a floor portion 100B. The beam or header portion 100A is that portion of the monolithic structure 100 that extends through the beam former 16. The floor portion 100B is that portion of the monolithic concrete structure 100 that lies above the deck 70 and extends across the deck and even over the beam or header portion 100A.

Figure 9:
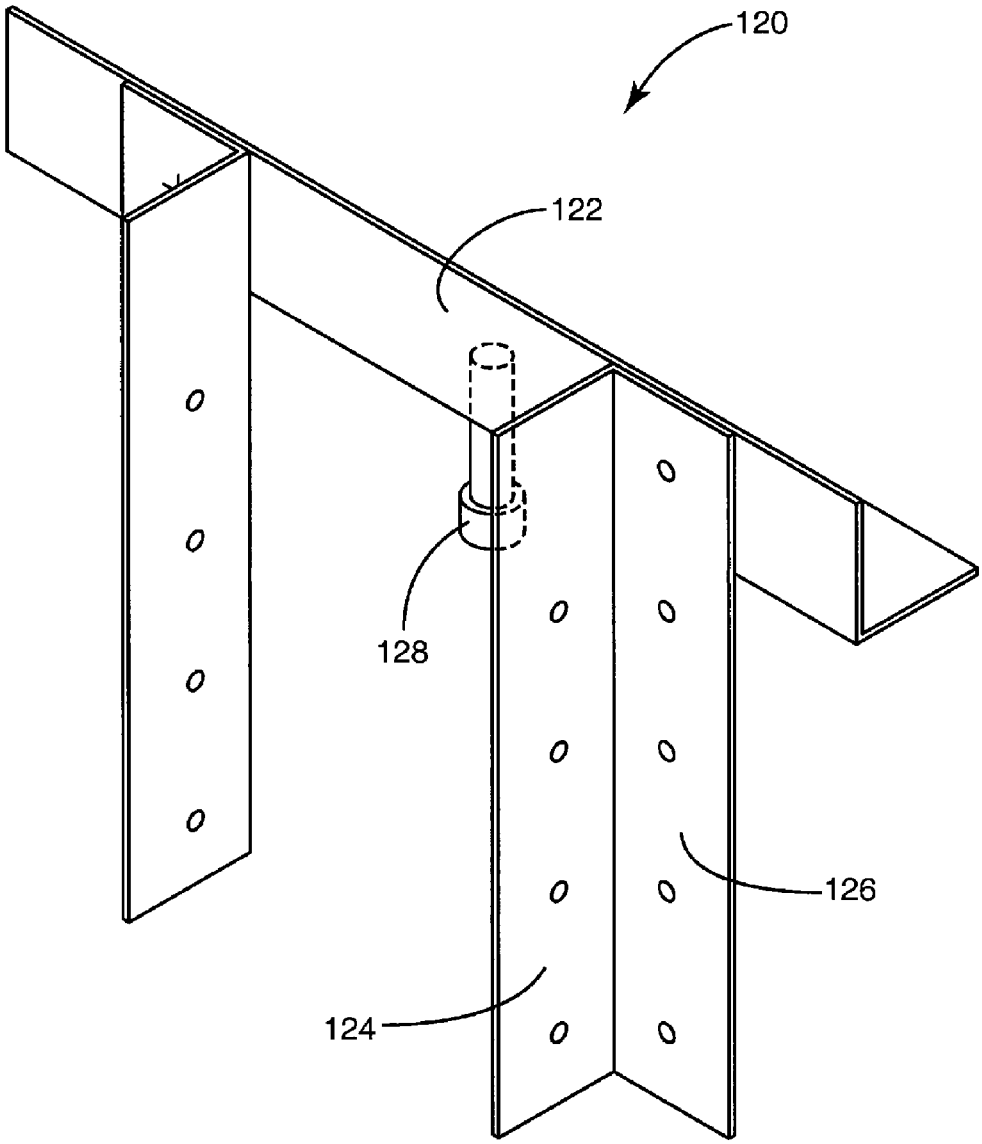
FIG. 9 is an alternative design for a joist support.

The joist hanger 20 is discussed above. In that discussion, the embodiment of FIG. 6 was discussed. An alternate embodiment for the joist hanger 20 is shown in FIG. 9. Here, the joist hanger or support is indicated generally by the numeral 120. Joist support 120 includes a cross member 122. Depending downwardly from the cross member 122 on opposite sides is an angled bracket. The angled bracket on each side of the joist support 120 includes a connecting strip 124 that attaches to one side 16B of the beam former 16. Extending outwardly from the connecting strip 124, at a generally 90° angle, is a flange 126. Both the connecting strip 124 and flange 126 include openings for receiving fasteners. In addition joist support 120 includes an anchor 128 that is fixed to the cross member 122 and depends downwardly therefrom. Anchor 128 is designed to rest in the concrete and to effectively tie the joist support 120 to the concrete beam 100A formed in the beam former 16.

Figure 8:
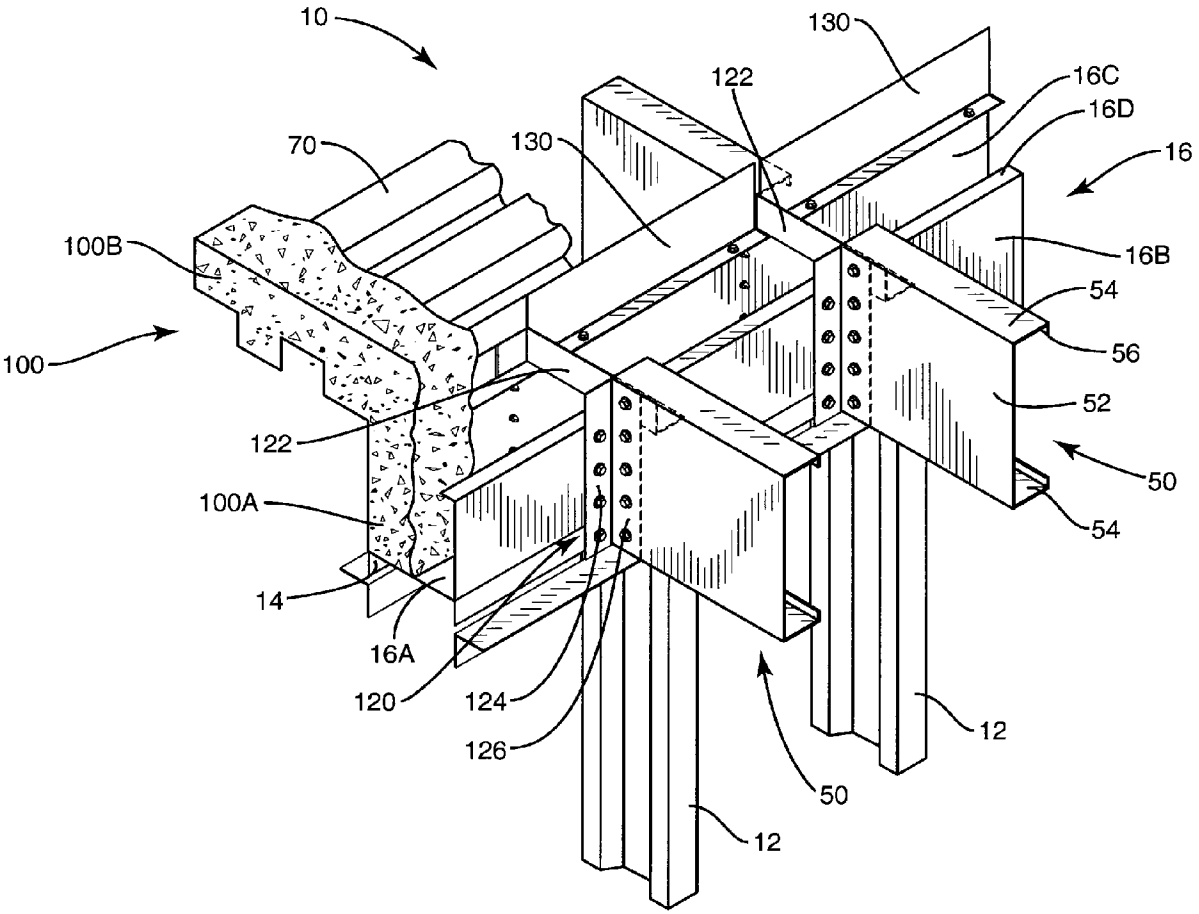
FIG. 8 is a fragmentary perspective view, similar to FIG. 1, but showing a modified structure.

The joist hanger or joist support 120 shown in FIG. 9 is utilized in the building structure 10 shown in FIG. 8. Because of the construction of the joist support 120, the joists 50, when connected, are slightly elevated with respect to the position the joists assume in the FIG. 1 embodiment, for example. This is because the cross member 122 is turned at an angle as it extends over the beam former 16 and the top of the joist support 120 extends slightly above the top of the beam former 16. This effectively raises the joists 50 and also raises the deck 70. Therefore, when concrete is poured onto the deck 70 and into the beam former 16, there is a need to prevent concrete from spilling out between the deck 70 and the upper portions of the beam former 16. As illustrated in FIG. 8, the building structure 10 is provided with a series of pour stops 130 that prevents concrete from spilling out, or running between the deck 70 and the upper portion of the beam former 16.

Figure 7:
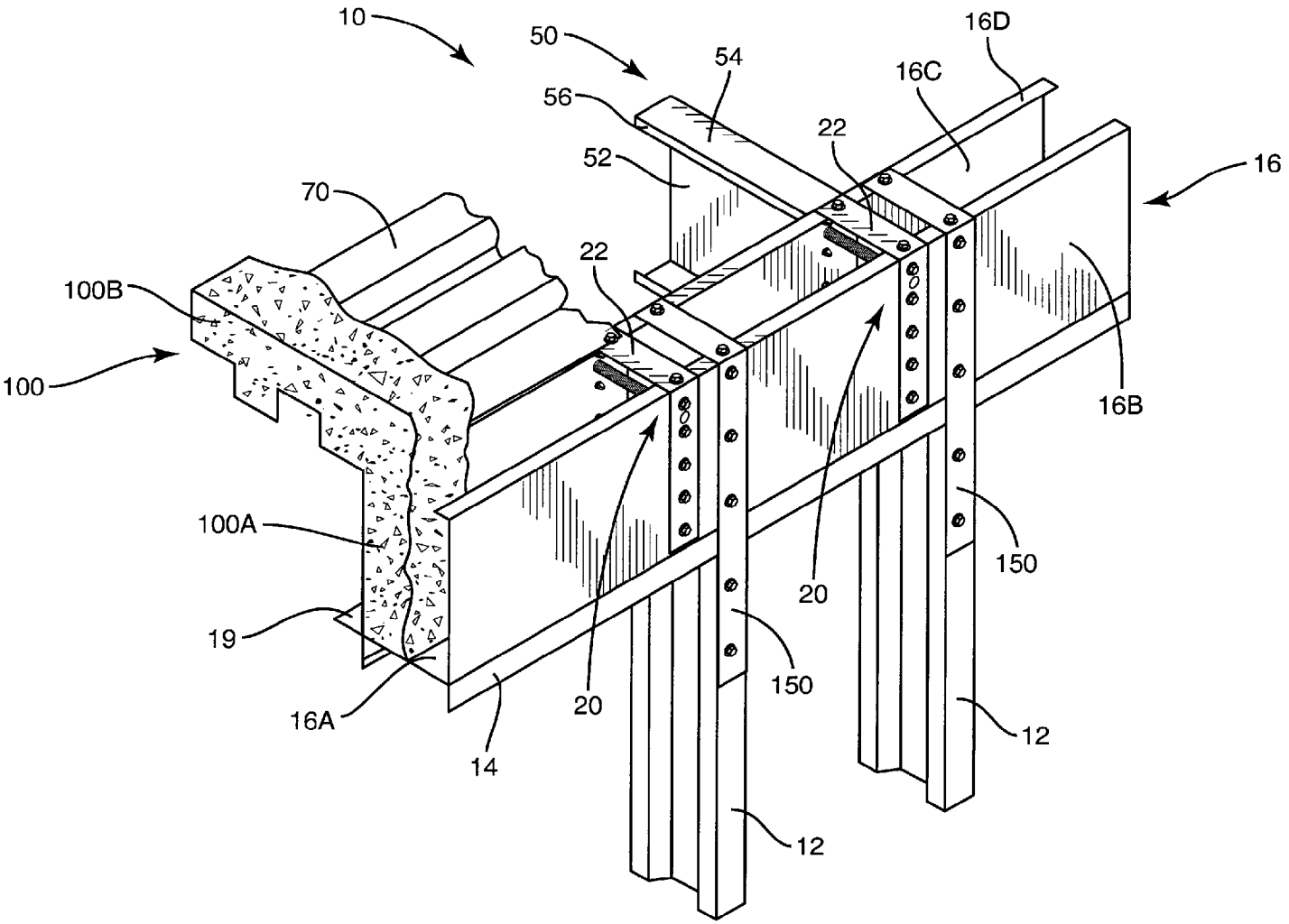
FIG. 7 is a fragmentary perspective view similar to FIG. 1 but particularly adapted to be used at an end-of-run condition.

FIG. 7 illustrates a slight modification to the building structure 10 shown in FIG. 1. In the case of the FIG. 7 embodiment, this design is utilized at an end-of-run condition. That is, this condition occurs where joists 50 only extend from one side of the beam former 16. Therefore, on the right side of the joist hangers 20 shown in FIG. 7, there will be no outwardly extending flanges for connecting to a series of joists. Likewise, there may not be a need for a reinforcing strip 19 to extend along the right side of the upper channel 14. In order to accommodate this situation, the joist supports 20 may be slightly modified to exclude outwardly projecting flanges on the right side.

FIG. 7 (illustrates another slight modification of the building structure 10 with respect to that discussed above and particularly the design shown in FIG. 1. In the FIG. 7 embodiment, there is provided a series of straps 150 interconnecting the beam former 16 with studs 12. Note that each strap 150 extends in a straddle fashion over the beam former 16 and downwardly along the flanges of the webs 12. A series of fasteners are used to secure the strap 150 to both the beam former 16 and the studs 12.

Figure 3:
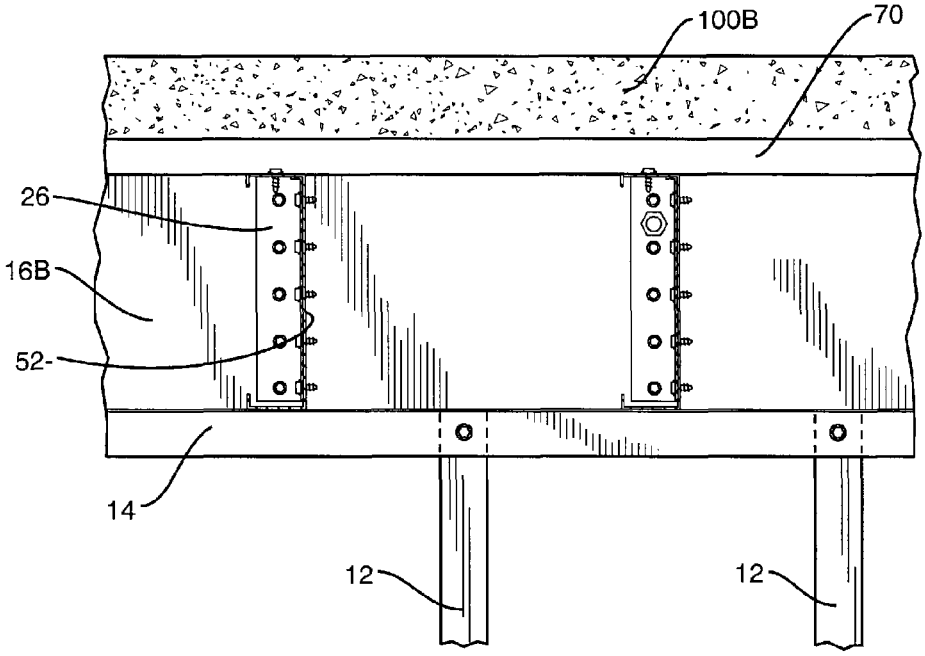
FIG. 3 is a view taken along the line of FIG. 1.

There are many advantages to the building structure 10 of the present invention. The building structure 10 obviates the need for inline framing between joist 50 and wall studs 12. FIG. 3 illustrates this feature of the building structure 10. There is no requirement that the joists 50 be aligned with the studs 12. That is, the joists 50 and studs 12 can be misaligned and this enhances the flexibility of the building structure discloses herein. It also obviates the need for inline framing between stud walls above and stud walls below. The studs 12 can be located anywhere with respect to the supporting joists 50. In addition, the poured concrete beam or header 100A is load-bearing and removes the need for any additional load-distributing elements, such as steel tubes, beams, or heavy light gauge steel headers.

Other objects and advantages of the present invention will become apparent and obvious from a study of the following description and the accompanying drawings which are merely illustrative of such invention.

The present invention may, of course, be carried out in other ways than those specifically set forth herein without departing from essential characteristics of the invention. The present embodiments are to be considered in all respects as illustrative and not restrictive, and all changes coming within the meaning and equivalency range of the appended claims are intended to be embraced therein.

What is claimed is:

1. A light gauge cold formed steel building structure, comprising:

a plurality of spaced-apart light gauge cold formed steel studs that form at least a portion of a wall;

an elongated light gauge cold formed steel beam former for forming and holding a concrete beam;

the beam former being aligned with and at least partially-supported by the studs;

the beam former including a bottom, pair of side walls, and an open top that permits concrete to be poured into the beam former;

a plurality of spaced-apart joist supports connected to the beam former, wherein each joist support straddles the beam former and includes a cross member that extends across the top of the beam former and a pair of opposed members that extend adjacent the sides of the beam former; and a plurality of light gauge cold formed steel joists, with each joist being connected to one of the plurality of joist supports and extending generally outwardly from the beam former.

2. The building structure of claim 1 including, a metal deck for supporting a concrete floor, the deck being at least partially supported by the plurality of joists;

a concrete structure supported by the deck and beam former; and the concrete structure including integral floor and beam portions, the beam portion extending through the beam former and the floor portion lying over the deck.

3. The building structure of claim 2 wherein the bottom of the beam former is spaced below the deck and wherein portions of the beam portion of the concrete structure extends below the floor portion of the concrete structure.

4. The building structure of claim 1 wherein each opposed member of the joist supports includes a flange extending at an angle with respect to the adjacent side of the beam former, and wherein the flange attaches to one of the joists.

5. The building structure of claim 1 including a tab projecting downwardly from the cross member into the beam former and wherein the tab is embedded within a concrete beam formed by the beam former and extending through a portion of the beam former.

6. The building structure of claim 1 including a transverse member that interconnects opposed members of the joist support and which extends transversely through the beam former.

7. The building structure of claim 6 wherein the transverse member is a bolt.

8. The building structure of claim 4 including a series of fasteners that project into the sides of the beam former and secure the joist support to the beam former.

9. The building structure of claim 1 wherein one or more joists are misaligned with the studs.

10. The building structure of claim 1 including a plurality of longitudinally-spaced reinforcement plates disposed in the beam former, each reinforcing plate extending between opposed sides of the beam former.

11. A construction assembly for forming a building structure, comprising:

a series of spaced-apart studs that form at least a portion of a wall structure;

a light gauge cold formed steel beam former having a bottom, pair of sides, and an open top, the beam former configured to be aligned with and disposed over the studs and at least partially supported by the studs for forming an elongated concrete beam over the studs and configured to remain a part of the building structure after the concrete beam has been formed; and a plurality of joist supports configured to be connected to the beam former, where each joist support includes a cross member that is configured to extend across the open top of the beam former and a pair of opposed members that extend adjacent the sides of the beam former.

12. The construction assembly of claim 11 including a U-shaped track disposed between the beam former and the upper portion of the studs.

13. The construction assembly of claim 12 including series of light gauge cold formed steel joists connected to the joist supports.

14. A method of forming a wall and a reinforced concrete header over the wall using light gauge cold formed steel components, the method comprising:

forming a wall by erecting a series of spaced-apart light gauge cold formed steel studs;

placing a beam former constructed of light gauge cold formed steel over the studs and at least partially supporting the beam former with the studs and wherein the beam former includes a bottom, a pair of opposed sides, and an open top;

placing a plurality of joist supports along the beam former, such that each joist support extends across the top of the beam former and along the sides of the beam former; and forming a concrete header over the studs by pouring concrete into the open top of the beam former such that the concrete header extends through the beam former.

15. The method of claim 14 including extending a series of joists from the beam former and the concrete header extending through the beam former and allowing the possibility of misaligning a plurality of the joists with the studs.

16. The method of claim 15 including supporting a deck on the joists and pouring concrete onto the deck and forming a monolithic concrete structure comprised of the concrete header and a concrete floor.

17. The method of claim 14 including supporting a deck on the series of joists and overflowing concrete from the beam former such that the concrete flows onto the deck to form a concrete floor that results in a monolithic concrete structure made up of the concrete floor and the concrete header extending through the beam former.

18. The method of claim 15 including:

supporting a deck on the series of joists;

pouring concrete onto the deck to form a concrete floor; and forming a monolithic concrete structure comprising the concrete header and the concrete floor.

* * * * *